US005351894A

United States Patent [19]

Longhurst et al.

[11] Patent Number: 5,351,894

[45] Date of Patent: Oct. 4, 1994

[54] METHOD FOR THE COMMINUTION OF BRITTLE MATERIAL FOR GRINDING

[75] Inventors: Donald A. Longhurst, Marietta, Ga.; Norbert Patzelt, Beckum, Fed. Rep. of Germany

[73] Assignee: Krupp Polysius AG, Fed. Rep. of Germany

[21] Appl. No.: 916,277

[22] Filed: Jul. 21, 1992

[30] Foreign Application Priority Data

Aug. 14, 1991 [DE] Fed. Rep. of Germany ..... 4126899

[51] Int. Cl.[5] ..... B02C 4/28

[52] U.S. Cl. ..... 241/21; 241/23

[58] Field of Search ..... 241/21, 23, 62, 65, 241/80, 97, 79.1

[56] References Cited

U.S. PATENT DOCUMENTS 4,134,731 1/1979 Houser ..... 242/24 X
4,484,928 11/1984 Keller, Jr. ..... 241/20 X
4,728,644 3/1988 Duill et al. ..... 241/80 X
4,753,660 6/1988 Kellerwessel et al. ..... 241/16 X
4,840,313 6/1989 Rubin et al. ..... 241/80 X
4,875,628 10/1989 Knobloch et al. ..... 242/24

FOREIGN PATENT DOCUMENTS 3717975 12/1988 Fed. Rep. of Germany .

*Primary Examiner*—Mark Rosenbaum
*Assistant Examiner*—Frances Han
*Attorney, Agent, or Firm*—Learman & McCulloch

[57] ABSTRACT

The invention relates to a method and apparatus for the comminution of brittle material for grinding, particularly send-like material such as metallurgical sand in the roller gap of a material bed roller mill. In order to create an optimum capacity for drawing in the material for grinding in the roller gap, the material for grinding at the inlet to the roller gap is set to a (mixed) moisture content of approximately 0.3 to 3.0%, preferably approximately 0.5 to 2.0%.

18 Claims, 2 Drawing Sheets

METHOD FOR THE COMMINUTION OF BRITTLE MATERIAL FOR GRINDING

TECHNICAL FIELD

The invention relates to a method and to apparatus for the comminution of brittle material for grinding, particularly sand-like material.

BACKGROUND

It is already known from DE-A-37 17 975 for brittle material for grinding to be crushed in the gap between two rollers which are pressed against one another at high pressure, wherein a part-stream of the comminuted material for grinding is returned to the roller gap and is further comminuted together with fresh material for grinding. In this connection the problem has arisen of satisfactorily comminuting material for grinding with a high moisture content which above a critical moisture value has a strong tendency to sticking end/or caking. In order to achieve this, at least a proportion of the part-stream returned to the roller gap is dried before re-introduction into the roller gap to such an extent that a mixed moisture content occurs in the roller gap which lies below the critical moisture content, and in this came the so-called "boundary moisture content" above which the material for grinding has a strong tendency to sticking and/or caking is taken to be 12%, so that a moisture content of somewhat below this value is sought. If the moisture content is regarded as too low then an artificial increase in the mixed moisture content is considered advantageous.

The object of the invention is to provide a method and apparatus with a reliable and relatively easily controllable mode of operation which ensures a particularly good capacity for drawing in brittle material for grinding, particularly sand-like brittle material for grinding, into the roller gap between two rollers of a material bed roller mill.

SUMMARY OF THE INVENTION AND ADVANTAGES

In the extensive tests on which the invention is based it has been found that in the communition of brittle material for grinding, such as for example ore, cement materials or the like and in particular also sand-like brittle material for grinding in the roller gap of a material bed roller mill both with a particularly high moisture content of the material for grinding and with dry or almost dry material, difficulties can occur with the drawing in of the material to be comminuted into the gap between the two rollers. For example, in the comminution of dry metallurgical sand (vitreous grains of blast furnace slag) a greatly reduced capacity for drawing in this material for grinding was established end, furthermore, the production of scabs (agglomerated particles of comminuted material like small plates) was greatly reduced to an undesirable extent, as a result of which the final comminution in the material bed of the roller mill was severely impaired or no longer possible in the required manner.

An optimum capacity for drawing in brittle material for grinding, and in particular sand-like brittle material, above all here metallurgical sand, in the roller gap of a material bed roller mill can be achieved by setting the material for grinding at the inlet to the roller gap to a (mixed) moisture content of approximately 0.3 to 3.0%, preferably approximately 0.5 to 2.0%. This moisture content results in extremely favourable scab production for the comminution.

A very favourable moisture content can be chosen in the range from approximately 0.6 to 1.5%. preferably around approximately 1%.

When the material for grinding to be freshly delivered is relatively dry, then it can also be advantageous within the scope of the present invention if the moisture content of the material for grinding running into the roller gap which is regarded as optimum for a good drawing-in capacity can be set or controlled by increasing the moisture content of this material for grinding by accurately controllable addition of water in the appropriate manner.

In numerous material bed roller mills of the aforementioned type as used in the art skewing of the rollers is often established, i.e. the two rollers of the material bed roller mills no longer run parallel to one another in the desired manner, so that an uneven gap was produced between the rollers or the surfaces thereof, being wider in the region of one end of the rollers than in the region of the opposite other ends. Moreover, undesirable vibrations, particularly of the rollers, have often been established in material bed roller mills in operation.

In the aforementioned extensive tests which have been carried out for this invention it was also found surprisingly that by the quite deliberate adjustment or control of the moisture content of the material for grinding running into the roller gap the mode of operation of the material bed roller mill can be controlled very reliably and relatively simply not only as regards a particularly good drawing-in capacity but also as regards the aforementioned skewing and the undesirable vibrations.

If in this connection we first of all consider only the skewing of the rollers which has been described above, then in the case of such skewing at least it is possible at least temporarily to increase the moisture content of the proportions of material for grinding delivered to the roller gap in the longitudinal region of the gap with the narrower width. It should be pointed out in this connection that other causes do lead to this skewing of the rollers, such as for example the delivery of large pieces of material in the region of one end of the rollers and fine material in the region of the opposite end of the rollers, or also a corresponding one-sided delivery of material for grinding from the feed bin. In the extensive tests it was also found in the case of certain brittle materials for grinding that an increase in the moisture content of the incoming material for grinding in the longitudinal region of the gap with the narrower width could very quickly stop the aforementioned skewing of the rollers, which could be achieved at an increased capacity for drawing in material for grinding in this region of the smaller gap width, and certainly at least by a temporary increase in the moisture content of the material for grinding entering this longitudinal region of the gap. This rapid remedy for the skewing of the rollers can be achieved most favourably by a direct and controlled addition of water. These measures have proved particularly advantageous in the comminution of metallurgical sand (granulated blast furnace slag) or similar sand-like brittle material for grinding.

The problem of undesirable vibrations on the rollers or of the roller mill as a whole can also be solved by a specific increase in the moisture content of the material for grinding being delivered to the roller gap. For this purpose a measurement signal derived from a vibration of the rollers can advantageously be utilised for controlling at least a temporary addition of water, and in this case the height of the vibration measurement value is also processed, during the general control of the moisture content, as a factor with a view to alteration of the moisture content of the material for grinding being delivered to the roller gap, i.e. if for example undesirable vibrations occur and become greater then the moisture content of the material for grinding being delivered or the additional water added is correspondingly Increased, whereas in the event of a decrease in the undesirable vibrations the addition of water is again correspondingly reduced or can even be stopped altogether (if for example in the meantime the mixed moisture content of the total material for grinding being delivered to the roller gap has been reset).

It should again be mentioned at this point that the aforementioned skewing of the rollers and also the undesirable vibrations are frequently attributable to the delivery of excessively dry material for grinding, which frequently occurs in practice in the case of the aforementioned metallurgical sand or similar brittle material for grinding; however, it should not be denied that there are also other causes—as mentioned above—which could lead to this undesirable behaviour of the rollers in operation. Thus for this reason it is advantageous if the measurement signals which announce the occurrence of these undesirable operating conditions are adduced not only for a direct alteration of the moisture content or an addition of water to the material for grinding but are evaluated and processed in a sensible manner as individual factors in the appertaining overall control of the moisture content.

The mixed moisture content of the material for grinding which is to be set according to the invention can be brought about in practical operation in different ways, each depending upon the material to be comminuted, the desired end product and the comminuting method or the corresponding comminuting apparatus to be chosen, and for control of this moisture content—as mentioned above—the current operational behaviour of the rollers or of the appertaining roller mill can be adduced and the aforementioned addition of water or fluid then serves to some extent as a type of grinding aid.

If on the other hand fresh material for grinding which is relatively moist is to be comminuted, then this moist fresh material can be dried overall before delivery to the roller gap to an adjustable moisture content of approximately 0.3 to 3.0%, preferably approximately 0.5 to 2.0%, for example in a corresponding drier connected upstream.

A further possibility also consists of drying a first quantity of relatively moist fresh material for grinding to a moisture content of approximately $\leqq 0.5\%$ in one drying arrangement, to guide a second quantity of fresh material in a bypass to the drying arrangement and then to guide both quantities of fresh material together before delivery to the roller gap, wherein these quantities of fresh material can advantageously be chosen to be of such a size that a mixed moisture content of 0.3 to 3.0%, preferably approximately 0.5 to 2.0%, is set before the roller gap.

Even if the entire fresh material for grinding or a corresponding quantity thereof is dried, so that the moisture content of the material for grinding to be delivered to the roller gap is set to the desired value, the moisture still contained in the material for grinding or the water which is still contained acts to some extent as a grinding aid for optimal drawing in of the material into the roller gap and for favourable scab production.

Furthermore, if in the comminution as described above of the brittle material for grinding a part-stream of the comminuted material for grinding is returned to the roller gap is to be further comminuted together with the fresh material for grinding, then according to the invention the procedure is such that the total material for grinding composed of the fresh material and the returned material is set at the inlet to the roller gap to the mixed moisture content of approximately 0.3 to 3.0%, preferably approximately 0.5 to 2.0%. In this case the returned material for grinding can be composed of a quantity of the material particles agglomerated into scabs and of tailings coming from a separating zone arranged downstream of the comminution. As already indicated above, the returned scabs ensure an optimum construction of the material bed in the material bed roller mill or in the gap between the two rollers of this roller mill.

In the hybrid and final grinding of the total material for grinding as set out above it is also advantageous with a predetermined material throughput capacity through the comminuting rollers to control the moisture content and quantity of the fresh material for grinding to be delivered as a function of the quantities and moisture contents of the quantity of scabs returned and the returned tailings. In this case the said material throughput capacity can be controlled for example according to a constant material feed quantity to the separating zone. The moisture content of the returned tailings can advantageously be set to a value of approximately $\leqq 0.5\%$, which is already achieved in any case by generally appropriately drying the comminuted material for grinding and thus also the tailings to be returned in the separating zone, i.e. usually in an adapted air separator. By contrast, the moisture content of the returned quantity of scabs corresponds essentially to the mixed moisture content of the total quantity of material for grinding delivered to the roller gap. In the control of the individual quantities of material for grinding to be delivered to the roller gap it can also be particularly advantageous if the quantity of returned scabs on the one hand and the ratio between returned tailings and fresh material for grinding to be newly delivered on the other hand are each kept substantially constant.

If the mass flows to be delivered to the roller gap have differing moisture contents and differing temperatures, then when these flows are led together vapour formation may occur, which could lead to caking during transport of the material for grinding to the roller gap. In order for this to be substantially avoided, it is also advantageous that the different mass flows of the fresh material for grinding and the material for grinding to be returned are mixed together shortly before the roller gap in such a way that the mass flows with relatively moist material flow from one side and the mass flows with relatively dry material flow from the opposite side towards one another and are brought together. This also ensures a sufficient intermixing of the different mass flows over their trajectory parabola while they are being brought together, as a result of which relatively expensive additional mixing devices can be avoided.

This method according to the invention is suitable in a particularly advantageous way for the comminution of metallurgical sand or similar brittle material for grinding (as fresh material for grinding).

Apparatus for the comminution of brittle material for grinding, particularly sand-like material for grinding such as metallurgical sand or the like, contains at least one material bed roller mill with a mill inlet, two contrarotating rollers which are pressed against one another at high pressure and a roller gap formed in the region between the rollers. Such apparatus is distinguished according to the invention in that arrangements for handling the delivered fresh material for grinding are arranged before the mill inlet in such a way that the material for grinding can be delivered to the roller gap with a moisture content of approximately 0.3 to 3.0%, preferably approximately to 2.0%.

THE DRAWINGS

The invention will be explained in greater detail below with the aid of the drawings, in which:

FIG. 1 shows a simplified flow diagram of a comminuting apparatus according to the invention, FIG. 2 shows a similar flow diagram of the comminuting apparatus which has been complemented by a moisture control arrangement.

DETAILED DESCRIPTION

Figure 1:
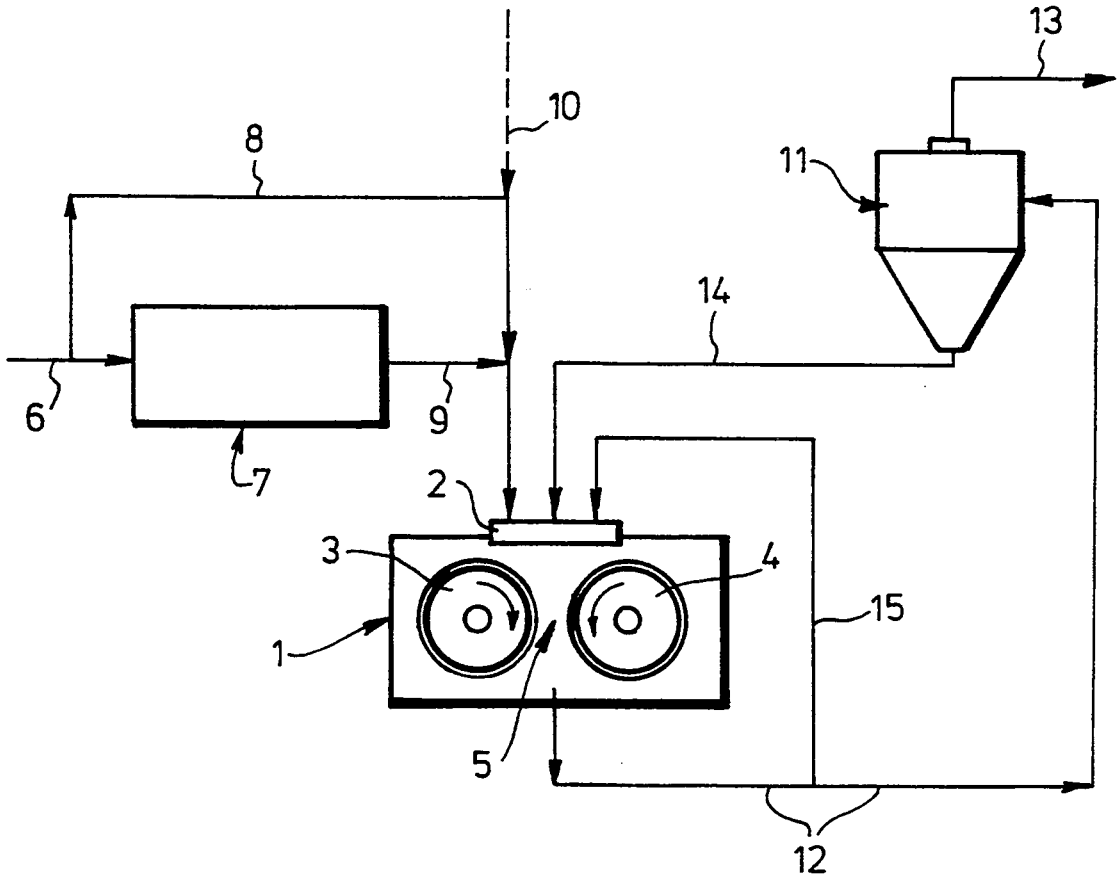

In FIG. 1 the comminuting apparatus is shown in greatly simplified form for the sake of clarity. This apparatus is intended in particular for the comminution of blast furnace slag contains a material bed roller mill 1 with a mill inlet 2 serving for the delivery of material for grinding, two contrarotating rollers 3, 4 pressed against one another at high pressure as well as a roller gap 5 formed in the region between these rollers. Arrangements for treating delivered material for grinding are arranged before the mill inlet 2 in such a way that all of the material for grinding can be delivered to the mill inlet 2 and thus to the roller gap with a moisture content of preferably between 0.5 and 2.0%.

In the illustrated example of the apparatus it may be assumed that blast furnace slag (arrow 6) which is still relatively moist is delivered as fresh material for grinding. Therefore this example of the apparatus contains as the arrangement before the mill inlet 2 a suitable drier 7 in which the delivered fresh material for grinding—which is preferably circulating continuously—can be dried to a sufficient extent. A bypass duct 8 for undried fresh material for grinding is also preferably coordinated with the drier 7. In the region before the mill inlet 2 this bypass duct 8 is led together with the dry material duct 9 coming from the drier 7.

Thus with the apparatus parts described above it is possible for a first quantity of the metallurgical send to be comminuted to be dried in the drier 7 to a sufficiently low moisture content, preferably approximately $\leqq 0.5\%$, whilst second quantity of the moist metallurgical send is led around the drier 7—bypassing it—in the bypass duct so that after the dried and undried (moist) fresh material for grinding have been brought together a mixed moisture or mixed moisture content can be achieved which is appropriate for the optimum drawing-in possibilities in the roller gap 5. Naturally, corresponding switch flaps can also be provided which facilitate disconnection of the bypass from the drier 7 or also permit complete bypassing of the freshly delivered metallurgical sand around the drier 7 (when the metallurgical sand is sufficiently dry). In the case of very dry metallurgical sand, which therefore no longer has to be passed through the drier, it can also be advantageous to increase its moisture content by the addition of water (cf. broken arrow 10) to a suitable value; apparatus parts for such addition of water will be dealt with in greater detail below in connection with FIG. 2.

The previously described apparatus can be used when pure comminution in one pass of metallurgical sand or the like is merely to be carried out at the aforementioned moisture content.

In the overall representation of the apparatus in the schematic drawings it is also assumed that this apparatus also includes a separating device, preferably in the form of a suitable air separator 11, which serves for the classification of material for grinding comminuted in the material bed roller mill 1. For this purpose a material duct 12 leads from the outlet of the material bed roller mill 1 to the air separator 11. From the air separator material for grinding which is sufficiently comminuted can be discharged from the apparatus via a fine material duct 13, whilst oversize material separated off as tailings is returned via a tailings duct 14 to the mill inlet 2 so that these tailings can be further comminuted together with fresh material for grinding. A scabs duct 15, which serves for returning at least a proportion of the scabs coming from the material bed roller mill 1 to the mill inlet 2, is branched off from the material duct 12. The tailings and scabs to be returned to the mill inlet 2 of the material bed roller mill 1 can each be conveyed separately via their ducts 14 and 15 respectively directly to the mill inlet, or there is also the possibility—not shown in detail in the drawings—that the tailings to be returned to the mill inlet 2 in accurately dosed quantities via a tailings bin (intermediate bin) end in adaptation thereto the scabs can be passed either directly to the mill inlet 2 or first of all to the tailings bin in a suitable end controllable manner.

It should be pointed out at this point that all the aforementioned ducts (6, 9, 12, 13, 14, 15) of the comminuting apparatus can basically be any kind of conveying arrangements, such as for example mechanical and pneumatic conveying arrangements, pipe ducts, etc.

In any case this apparatus offers several possibilities for delivering the material for grinding which is to be comminuted to the grinding gap with a mixed moisture content in the range of preferably between 0.5 and 2.0%, as has been explained above using different or complementary methods.

Some numerical examples are set out in support of the explanations given above of the method and the apparatus according to the invention.

| | | |
|---|---|---|
| total throughput of material for grinding | 250 t/h | |
| returned scabs | 138 t/h | = (S) |
| returned tailings | 84 t/h | = (G) |
| fresh material for grinding | 28 t/h | = (F) |
| moisture content, tailings | 0.5% | = (g) |
| moisture content, scabs | | = (s) |
| moisture content, fresh feed material | | = (f) |

Assumption: for reasons of stability a mixed moisture content (mixed moisture) of 1% $H_2O$ should be set before or at the inlet of the material roller mill. It is assumed in this case that the moisture content of the scabs is equal to the moisture content of the total material for grinding at the inlet to the roller mill or the roller gap.

With this assumption of the moisture content of the scabs of 1.0% a calculation from the following equation $$f = \left(\frac{G}{F} + 1\right)x * s - \left(\frac{G}{F}\right)x * g = \frac{G * s - G * g}{F} + s$$

gives a moisture content for the fresh material for grinding of 2.5%.

In this case, in order to achieve this moisture content the drier connected upstream of the material bed roller mill can be set to 2.5% residual moisture for the fresh material for grinding. If this should not be possible or sensible for process engineering reasons, then a proportion of the moist fresh material for grinding can be bypassed around the drier whilst only the other proportion of the fresh material for grinding is dried, so that a mixed moisture of dried and undried fresh material for grinding of 2.5% is produced.

The aforementioned mixed moisture of the fresh feed material or material for grinding can be achieved for example in the following way:

| | |
|---|---|
| moisture content of fresh material for grinding (metallurgical sand) before the drier | 8% |
| 1st part quantity of fresh material to drier | 20.5 t/h |
| moisture content of 1st part quantity of fresh material after drier | 0.5% |
| 2nd part-quantity of fresh material (bypass quantity without drying) | 7.5 t/h |

With the aid of the equation (formula) given above it is of course possible to calculate other desired (mixed) moisture contents for fresh feed material, and also any correspondingly altered moisture contents of the returned material or altered quantities of returned material.

Furthermore, the moisture content of the returned tailings can be kept at a predetermined value, for example preferably approximately 0.3 to 0.5%, by corresponding setting of the separating air temperature in the separator (e.g. 95° to 100° C. at the separator outlet). In this case the moisture content of the scabs—possibly with slight variations upwards or downwards—will be approximately of the order of magnitude of the moisture content of the total material for grinding at the mill inlet.

The two examples of different material throughput capacities through the material bed roller mill or its comminuting rollers which are set out in the following table show clearly that the quantity of returned scabs on the one hand and the ratio between returned tailings and fresh material for grinding to be newly delivered on the other hand can each be kept substantially constant.

| | | | |
|---|---|---|---|
| total material throuhput quantity | 100% | 250 t/h | 270 t/h |
| returned scabs | approx. 55% | 138 t/h | 149 t/h |
| air separator feed quantity | approx. 45% | 112 t/h | 121 t/h |
| returned tailings | | 84 t/h | 91 t/h |
| requirement for fresh material for grinding | | 28 t/h | 30 t/h |
| ratio of returned tailings to fresh material for grinding approx. | | 3:1 | 3:1 |

This table relates to fine grinding of metallurgical sand in a comminuting apparatus corresponding to the embodiment illustrated in the drawings.

It can be inferred from the examples in this table that the percentage (approximately 55%) of returned scabs is set substantially constant and accordingly an increase in the total quantity of material for grinding to the material bed roller mill and thus of its material throughput capacity (quantity) leads to an increase in the quantity of returned scabs. Furthermore, a requirement for fresh material for grinding is in each case dependent upon the quantity of fines extracted in the air separator. In this way the quantity of returned tailings to the material bed roller mill is also determined.

In this connection it should also be pointed out that a kind of buffer silo for returned tailings can also be arranged in the region between the air separator and the mill inlet of the material bed roller mill in order to be able to control appropriately the quantity of tailings required for the material throughput capacity of the roller mill, which can be achieved for example by continuous level measurement and control, in which case a constant level—corresponding to the requirements—can be achieved by a corresponding raising or lowering of the quantity of tailings to be returned. The requirement for fresh material for grinding to be newly delivered to the material bed roller mill is then produced from the total quantity of material for grinding (material throughput capacity) for the roller mill minus the quantity of returned tailings and minus the quantity of returned scabs.

Thus by the use of the method according to the invention well as the apparatus according to the invention it is possible in order to achieve an optimum drawing-in capacity and optimum comminution conditions to set and maintain an advantageous mixed moisture content therefor in the range of preferably approximately 0.5 to 2.0%, for which purpose above all the moisture contents of the fresh material for grinding to be newly delivered and the returned tailings on the one hand and the respective part-quantities of returned scabs, returned tailings and fresh material for grinding to be newly delivered on the other hand can be adduced, in each case on the assumption that the moisture content of the returned scabs corresponds approximately to the moisture content of the total quantity of material for grinding delivered to the communiting rollers and thus can be kept substantially constant. Furthermore, if the returned tailings have a constant moisture content (because of the drying as described above of the material for grinding to be delivered to the air separator), then it is merely necessary to calculate and control the moisture content of the fresh material for grinding to be newly delivered, that is to say that the only moisture component which can be freely chosen is the moisture content of the fresh material for grinding to be newly delivered (from the drier and/or bypass), and this moisture content is then set so that the average moisture of all the part-streams of material for grinding delivered to the mill inlet (=total quantity of material for grinding) corresponds to the desired moisture content in the roller gap.

Figure 2:
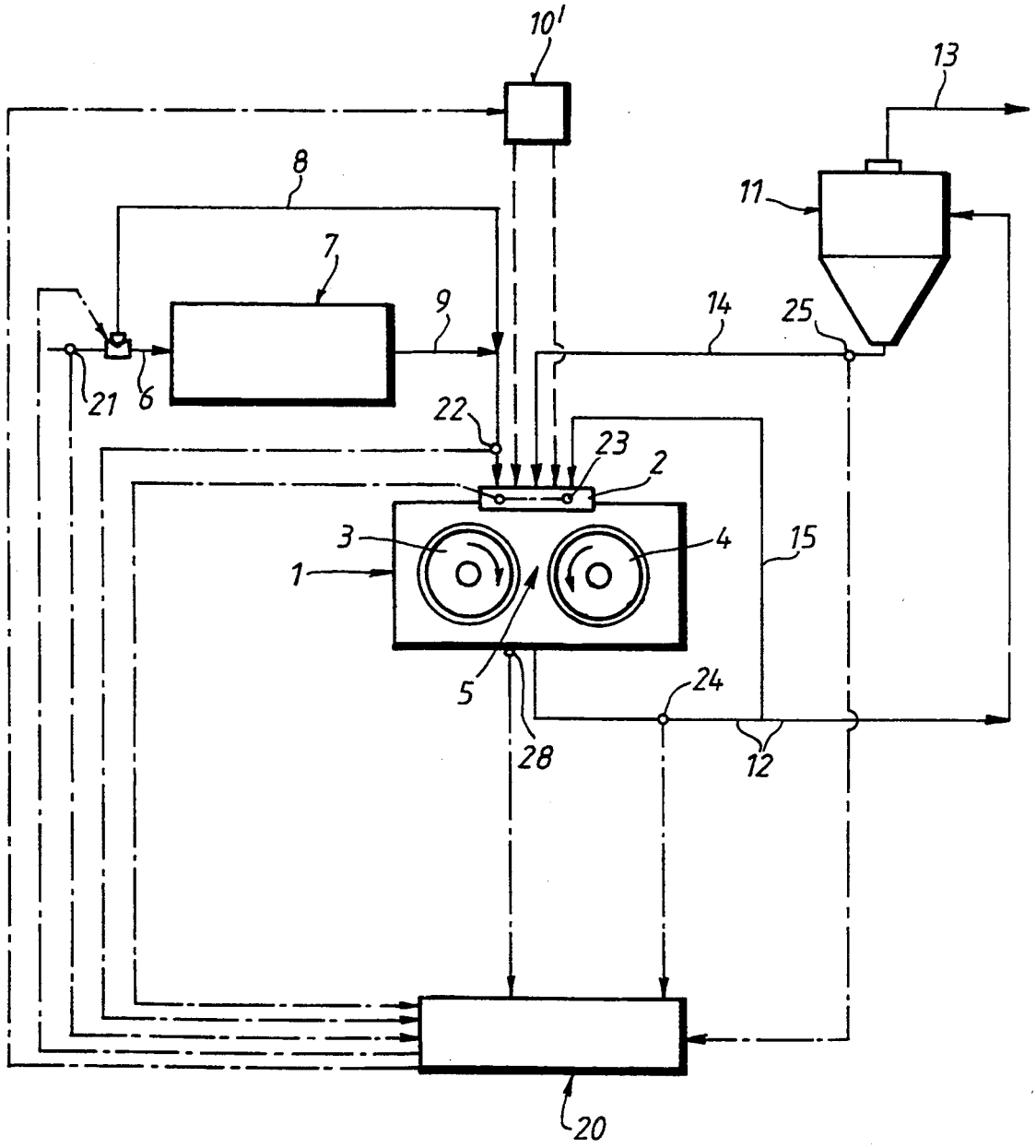

As has already been explained in greater detail above in the description of the method features, it is also advantageous if in addition to the moisture setting or control described above with the aid of FIG. 1 measurements or measurement signals of any excessive vibrations of the rollers or roller mill which may occur are processed in a general moisture control system. Accordingly, FIG. 2 shows an example in which a comminuting apparatus according to FIG. 1 is complemented by a general moisture control system for the total quantity of material for grinding flowing into the roller gap 5 by means of a moisture control arrangement 20 which is only indicated schematically.

This moisture control arrangement 20 is connected to a number of moisture measuring arrangements disposed at suitable locations (cf. dash-dot connecting lines) and in fact to a measuring arrangement 21 for freshly delivered material for grinding (6), a measuring arrangement 22 for fresh material for grinding led together from the bypass duct 8 and the dry material duct 9, at least one measuring arrangement 23 for total material for grinding brought together at the mill inlet 2, a measuring arrangement 24 for comminuted material for grinding and a measuring arrangement 25 for returned tailings. The moisture measurement signals from these measuring arrangements 21 to 25 are processed as control signals for a mixed moisture content which can be preset.

Moreover, a vibration measuring arrangement 28 is associated with the roller mill I or its roller frame at at least one suitable location. This vibration measuring arrangement 28 is also connected to the moisture control arrangement 20 (cf. dash-dot lines), and its measurement signals can also be utilised as control signals for setting the moisture content. In this way by the use of the moisture control arrangement 20—with a view to at least temporary additional one-sided or overall addition of water by means of a water addition arrangement 10'—the water content at the inlet 2 of the roller mill 1 can be controlled so that undesirably high vibrations can be prevented or eliminated.

We claim:

1. A method of comminuting sand-like brittle material in a roller gap between a pair of high pressure, contrarotating rollers of a material bed roller mill, said method comprising:

delivering a quantity of fresh sand-like brittle material from a supply thereof to the roller gap for crushing; and maintaining the moisture content of the material just before said roller gap in an optimum range of 0.3% to 3.0%.

2. The method of claim 1 including maintaining the moisture content of the material delivered to said roller gap in an optimum range of 0.5% to 2.0%.

3. The method of claim 1 including maintaining the moisture content of the material delivered to said roller gap in an optimum range of 0.8% to 1.5%.

4. The method of claim 1 including drying said fresh material upstream of said roller gap to said optimum range.

5. The method of claim 1 wherein said fresh material initially has a moisture content in excess of the optimum range, said method including dividing said fresh material upstream of said roller gap into first and second parts, drying said first part to reduce its moisture content, and combining the first and second parts following drying of the first part in such proportions that at said roller gap the combined material has a moisture content within the optimum range.

6. The method of claim 5 including drying said first part to reduce the moisture content of said first part to about 0.5%.

7. The method of claim 1 wherein said fresh material initially has a moisture content less than that of the optimum range, said method including adding water to the fresh material upstream of said roller gap in such quantity as to increase the moisture content of the material at said roller gap to said optimum range.

8. The method of claim 1 including monitoring variations in the width of the roller gap, and increasing the moisture content of material at the narrowest width of said roller gap to a level above that of the remaining material delivered to the roller gap.

9. The method of claim 1 including monitoring the rollers for variation and adding water to said material upstream of the roller gap in response to vibration of the rollers.

10. The method of claim 1 including returning partially comminuted material that has passed through said roller gap to said roller gap and combining such partially comminuted material with fresh material from said supply in such proportions that the moisture content of the combined material at the roller gap is within the optimum range.

11. The method of claim 10 wherein some of the partially comminuted material is in the form of scabs.

12. The method of claim 10 including controlling the quantity and moisture content of fresh material delivered to the roller gap from said supply as a function of the quantity and moisture content of the returned partially comminuted material to maintain a predetermined material throughput through the mill.

13. The method of claim 10 including mixing the fresh material from the supply and the returned partially comminuted material upstream of the roller gap.

14. The method of claim 1 including separating relatively fine and relatively course fractions of said comminuted material downstream of said mill, and returning at least a portion of the relatively course fraction to said roller gap for further crushing.

15. The method of claim 14 wherein the returned relatively course fraction includes scabs and tailings, and including setting the moisture content of the returned relatively course fraction to about 0.5% and setting the moisture content of the returned scabs to about the moisture content of the fresh material delivered to the roller gap.

16. The method of claim 15 including maintaining the quantity of returned scabs substantially constant and maintaining the ratio between the returned tailings and the fresh material from said supply substantially constant.

17. The method of claim 1 wherein the fresh material from the supply comprises metallurgical sand.

18. The method of claim 1 including measuring upstream from said roller gap the moisture content of fresh material from said supply, and adjusting the moisture content of fresh material delivered to said roller gap to the optimum range.

* * * * *

UNITED STATES PATENT AND TRADEMARK OFFICE

CERTIFICATE OF CORRECTION

PATENT NO. : 5,351,894

DATED : October 4, 1994

INVENTOR(S) : Donald A. Longhurst, et al

It is certified that error appears in the above-indentified patent and that said Letters Patent is hereby corrected as shown below:

On the title page:

Please make the following change to the Abstract:

Line 3, change "send" to -- sand --.

Change:

Column 1, line 20, change "end" to -- and --; line 25, change "came" to -- case --; line 55, change "end" to -- and --.

Column 2, line 4, change "0.6" to -- 0.8 --.

Column 3, line 12, change "In" to -- in --.

Column 5, line 15, after "approximately" insert -- 0.5 --; line 53, change "send" to -- sand --; line 57 change "send" to -- sand --; line 58, after "duct" add -- 8,--.

Column 6, line 36, change "end" to -- and --; line 38 change "6" to -- 8 --.

Column 8, line 28, change "vention well" to -- vention as well --.

UNITED STATES PATENT AND TRADEMARK OFFICE

CERTIFICATE OF CORRECTION

PATENT NO. : 5,351,894

DATED : October 4, 1994

INVENTOR(S) : Donald A. Longhurst, et al

It is certified that error appears in the above-indentified patent and that said Letters Patent is hereby corrected as shown below:

Column 9, line 19, change "I" to -- 1 --.

Column 10, line 16, change "variation" to -- vibration --.

Signed and Sealed this

Sixth Day of December, 1994

*Attest:*

*Attesting Officer*

BRUCE LEHMAN

*Commissioner of Patents and Trademarks*